US011763789B2

(12) United States Patent
Gao

(10) Patent No.: US 11,763,789 B2
(45) Date of Patent: Sep. 19, 2023

(54) SILENCER

(71) Applicant: NINGBO GNS AUTO PARTS CO., LTD., Ningbo (CN)

(72) Inventor: Qiang Gao, Ningbo (CN)

(73) Assignee: NINGBO GNS AUTO PARTS CO., LTD., Ningbo (CN)

( * ) Notice: Subject to any disclaimer, the term of this patent is extended or adjusted under 35 U.S.C. 154(b) by 0 days.

(21) Appl. No.: 17/655,675

(22) Filed: Mar. 21, 2022

(65) Prior Publication Data

US 2023/0067947 A1 Mar. 2, 2023

(30) Foreign Application Priority Data

Aug. 25, 2021 (CN) ..... 202110979829.0

(51) Int. Cl.

| | |
|---|---|
| ***G10K 11/16*** | (2006.01) |
| ***F01N 1/08*** | (2006.01) |
| ***F04B 39/00*** | (2006.01) |

(52) U.S. Cl.

CPC ..... *G10K 11/161* (2013.01); *F01N 1/086* (2013.01); *F04B 39/0055* (2013.01)

(58) Field of Classification Search

CPC ..... F04B 39/0055; F01N 1/086; F01N 1/087; F01N 1/12; F02M 35/1227; G10K 11/161

USPC ..... 181/251, 275, 279, 280

See application file for complete search history.

(56) References Cited

U.S. PATENT DOCUMENTS

| | | | | |
|---|---|---|---|---|
| 3,114,430 | A * | 12/1963 | Gallagher | F01N 13/007 181/254 |
| 5,020,631 | A * | 6/1991 | DeVille | F01N 13/1838 181/252 |
| 6,633,646 | B1 * | 10/2003 | Hwang | G10K 11/175 181/227 |
| 7,055,648 | B2 * | 6/2006 | Byrne | F02C 7/045 60/226.3 |
| 7,117,973 | B2 * | 10/2006 | Graefenstein | F01N 1/12 181/279 |
| 7,770,694 | B2 * | 8/2010 | Baars | F04C 29/068 181/266 |
| 8,104,572 | B2 * | 1/2012 | Butler | F01N 1/087 181/279 |
| 8,627,921 | B2 * | 1/2014 | Mead | F01N 3/28 181/251 |
| 2007/0284178 | A1 * | 12/2007 | Scanlon | F01N 1/087 180/309 |
| 2020/0043456 | A1 * | 2/2020 | Zhang | F01N 1/088 |

FOREIGN PATENT DOCUMENTS

| | | | | |
|---|---|---|---|---|
| CN | 102628392 | A | 8/2012 | |
| DE | 19543967 | A1 * | 5/1997 | F02M 35/1227 |

* cited by examiner

*Primary Examiner* — Jeremy A Luks
(74) *Attorney, Agent, or Firm* — INNOVATION CAPITAL LAW GROUP, LLP; Vic Lin

(57) ABSTRACT

A silencer comprises a main air guide tube provided with an air guide channel; the main air guide tube comprises an air inlet end and an air outlet end; both ends of an assistant air guide tube are connected with an outer wall of the main air guide tube, and the assistant air guide tube comprises a guide section and a reflux section; the guide section is provided with an air inlet, and the air inlet is communicated with the air guide channel; the reflux section is provided with an air outlet, and the air outlet is communicated with the air guide channel.

9 Claims, 6 Drawing Sheets

SILENCER

BACKGROUND OF THE INVENTION

1. Technical Field

The present invention relates to the technical field of silencers, in particular to a silencer.

2. Description of Related Art

It is easy for gas to generate noise in a rapid flowing process. As noise is prone to affecting the normal life of people, it is a necessity to employ a silencer to reduce noise. There are many application scenes of the silencers, for example, devices such as automobiles, ships, guns, air compressors, and air blowers. The silencers are primarily mounted on air flow channels or exhaust systems of aerodynamic devices.

The silencers may be divided into dissipative silencers, resistant silencers, impedance compound silencers, micro-perforated plate silencers, small-bore silencers and active silencers according to silencing principles. Some of the silencers reduce the flow rate of gas by lengthening the exhaust distance of the air flow so as to reduce noise. Some of the silencers reduce noises by forming small holes in the air guide tube. However, current silencers are generally complex in structure. Various components are mounted in the air guide tube, so that it is also troublesome to manufacture and assemble the silencer.

BRIEF SUMMARY OF THE INVENTION

Aiming at defects in the prior art, the present invention aims to provide a silencer which is simple in structure, easy to manufacture and assemble, and good in silencing effect.

The technical scheme of the present invention to solve the technical problem is as follows: provided is a silencer, including:

a main air guide tube provided with an air guide channel, the main air guide tube including an air inlet end and an air outlet end away from the air inlet end;

an assistant air guide tube, both ends of an assistant air guide tube being connected with an outer wall of the main air guide tube, and the assistant air guide tube including a guide section and a reflux section communicated with each other; an end of the guide section away from the reflux section being provided with an air inlet, and the air inlet being communicated with the air guide channel; an end of the reflux section away from the guide section being provided with an air outlet, and the air outlet being communicated with the air guide channel; and a separation distance between the air outlet and the air inlet end being greater than that between the air inlet and the air inlet end;

wherein an air flow may enter the air guide channel from the air inlet end and is divided into a first branch flow and a second branch flow when flowing through the air inlet; the first branch flow flows to the air outlet end continuously along the air guide channel; the second branch flow enters from the air inlet, and is exhausted from the air outlet along the assistant air guide tube and comes together with the first branch flow; and a flow direction of the second branch flow flowing out of the air outlet is opposite to that of the first branch flow.

Further, the guide section inclines outwards gradually from an end close to the air inlet towards an end away from the air inlet, the reflux section being arranged in an arc-shaped tube shape.

Further, an included angle between the arc-shaped tube in a tangential direction at an end of the air outlet and a center line of the main air guide tube is an acute angle.

Further, the air outlet end of the main air guide tube is an upper end, the air inlet end thereof is a lower end, and the arc-shaped tube inclines downwards in the tangential direction at the end of the air outlet.

Further, there are a plurality of assistant air guide tubes and the assistant air guide tubes are evenly distributed on an outer wall of the main air guide tube.

Further, multiple rows of assistant air guide tubes are distributed on the outer wall of the main air guide tube, and each row of assistant air guide tubes includes a plurality of assistant air guide tubes evenly distributed in a circumferential direction of the main air guide tube.

Further, the air outlet end of the main air guide tube is the upper end, and the air inlet end thereof is the lower end; the upper end of the main air guide tube is provided with a plurality of first assistant air guide tubes and the lower end of the main air guide tube is provided with a plurality of second assistant air guide tubes; and a first gap exists between adjacent two first assistant air guide tubes, a second gap exists between adjacent two second assistant air guide tubes, one second assistant air guide tube is arranged below the first gap, and one first assistant air guide tube is arranged above the second gap.

Further, the silencer further comprising an air inlet tube and an air outlet tube, the air inlet tube being connected with the air inlet end in a plugged manner and the air outlet tube being connected with the air outlet end in a plugged manner.

Further, the air outlet end is provided with a first convex ring along the circumferential direction of the main air guide tube, and the air outlet end is provided with a second convex ring along the circumferential direction of the main air guide tube; and the air inlet tube is connected in the first convex ring in a plugged manner and the air outlet tube is connected in the second convex ring in a plugged manner.

Further, the silencer further comprising a housing, one end of the housing sleeving the air inlet tube and the other end thereof sleeving the air outlet tube, wherein the housing is provided with an accommodation cavity, in which the main air guide tube and the assistant air guide tubes are accommodated.

Compared with the prior art, the present invention at least has the following beneficial effects:

in the present invention, the plurality of assistant air guide tubes are evenly distributed on the main air guide tube, and each of the assistant air guide tubes includes the guide section and the reflux section that are communicated with each other. When a gas enters from the air inlet end, a part of air flow (the first branch flow) flows towards the air outlet end continuously along the air guide channel while the other part of air flow (the second branch flow) enters from the air inlet of the assistant air guide tube, flows in sequence along the guide section and the reflux section, and flows out from the air outlet of the reflux section. The flow direction of the air flow flowing through the reflux section faces the air inlet end, i.e., the second air flow flows through the reflux section to generate a reflux that comes together with the air flow (the first branch flow) flowing towards the air outlet end from the air inlet end, so that the speed of the first branch flow may be reduced quickly. During the process where the air flow moves in the assistant air guide tube, the flowing of the air flow is equivalently lengthened and double speed reduction effects are exerted to the air flow equivalently, so that the silencing effect is good, and the integral structure of the silencer is quite simple. There is no need to arrange any part in the main air guide tube, so that it is also quite easy to manufacture and assemble the silencer

BRIEF DESCRIPTION OF THE SEVERAL VIEWS OF THE DRAWINGS

The present invention is detailed in conjunction with the drawings and the embodiments below.

In the drawings.

Figure 1:
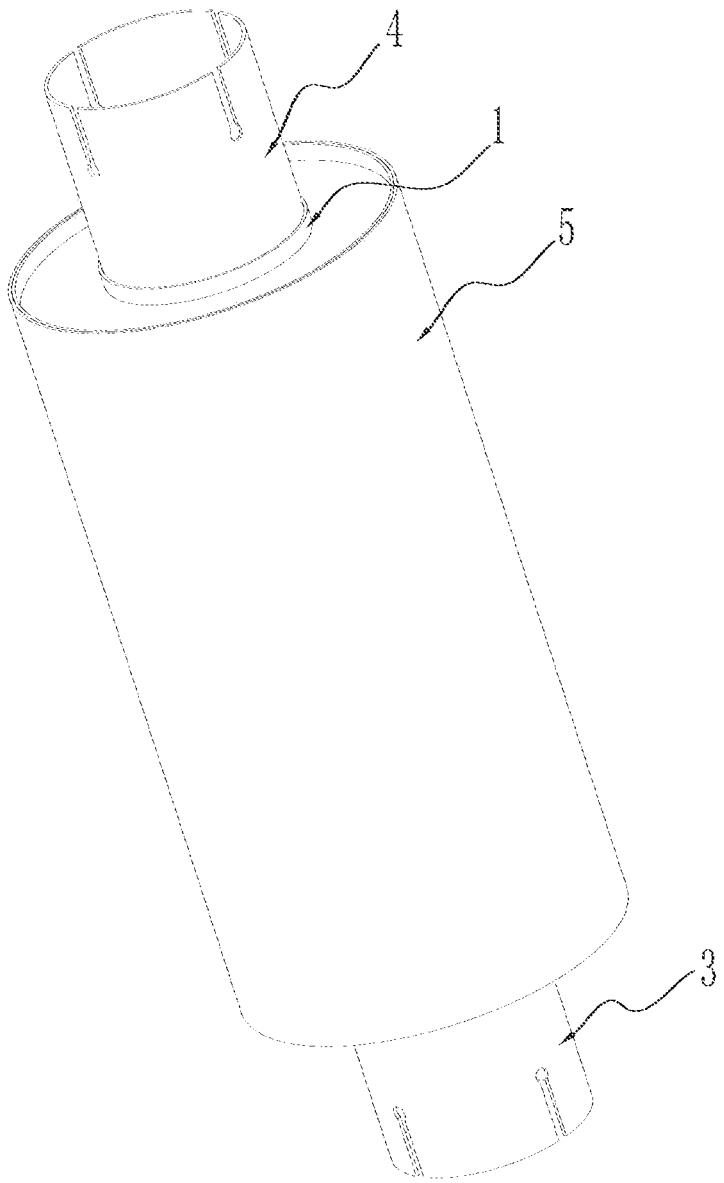
FIG. 1 is a structural schematic diagram of a silencer of the present invention.

1, main air guide tube; 10, air guide channel; 11, air inlet end; 110, first convex ring; 12, air outlet end; 120, second convex ring;

2, assistant air guide tube; 20, guide section; 201, air inlet; 21, reflux section; 211, air outlet; 2A, first assistant air guide tube; 2B, second assistant air guide tube; 22, first gap; 23, second gap;

3, air inlet tube;

4, air outlet tube;

5, housing; 50, accommodation cavity;

g, air flow; g1, first branch flow; g2, second branch flow.

DETAILED DESCRIPTION OF THE INVENTION

Specific embodiments of the present invention are described below, and further descriptions of the technical scheme of the present invention are made below in combination with the drawings. The present invention is not limited to the embodiments.

It is to be noted that all directional indications (for example, upper, lower, left, right, front, back and the like) in the embodiment of the present invention are merely used for explaining relative positional relations, moving conditions, and the like among components in a certain special position (as shown in the drawings). If the special position changes, the directional indications change correspondingly.

In addition, terms 'first', 'second', 'one', and the like are only used for a description purpose rather than being construed to indicate or imply relative importance or implicitly indicate the quantity of indicated technical features. Thus, features defining 'first', 'second', and the like can expressively or implicitly include at least one feature. In the description of the present invention, unless otherwise specified, 'a plurality of' means at least two, for example, two, three, etc.

In the present invention, unless otherwise expressly stated and defined, terms 'connect', 'fix', and the like shall be understood in a board sense, for example, 'fix' may be fixedly connected, detachably connected, or integrally connected; they may be mechanically connected or electrically connected; they may be directly connected or connected via an intermediate, or they may communication of two components insides or an interactive relation of the two components, unless otherwise specified. Those skilled in the art can understand the specific meanings of the terms in the present invention under specific circumstances.

In addition, the technical schemes of the embodiments of the present invention may be combined with each other based on implementation by those of ordinary skill in the field. When the technical schemes contradict each other in combination or may not be realized, it is to be considered that there is no combination of the technical schemes, which shall not fall into the protection scope of the present invention.

As shown in FIG. 1 to FIG. 6, a silencer includes a main air guide tube 1 provided with an air guide channel 10, the main air guide tube 1 including an air inlet end 11 and an air outlet end 12 away from the air inlet end 11; and an assistant air guide tube 2, both ends of the assistant air guide tube 2 being connected with an outer wall of the main air guide tube 1. Compared with an existing silencer, a core component of air flow speed reduction and noise reduction is arranged in the air guide tube. According to the scheme, the core component: the assistant air guide tube 2 for noise reduction is arranged on the outer wall of the main air guide tube 1, so that it is easy to manufacture and assemble the silencer. The assistant air guide tube 2 includes a guide section 20 and a reflux section 21 communicated with each other. The guide section 20 refers to not changing the flow direction of the air flow after the second air flow g2 flows in the guide section. The reflux section 21 refers to changing the flow direction of the air flow after the second air flow g2 flows in the guide section, so that the air flow flows towards the air inlet end 11. An end of the guide section 20 away from the reflux section 21 is provided with an air inlet 201, and the air inlet 201 is communicated with the air guide channel 10; an end of the reflux section 21 away from the guide section 20 is provided with an air outlet 211, and the air outlet 211 is communicated with the air guide channel 10. Both ends of the assistant air guide tube 2 are communicated with the air guide channel 10 of the main air guide tube 1. A separation distance between the air outlet 211 and the air inlet end 11 is greater than that between the air inlet 201 and the air inlet end 11, which means the air outlet 211 is close to the air outlet end 12, and the air intet 201 is close to the air inlet end 11, and the whole assistant air guide tube 2 is substantially J-shaped.

Figure 2:
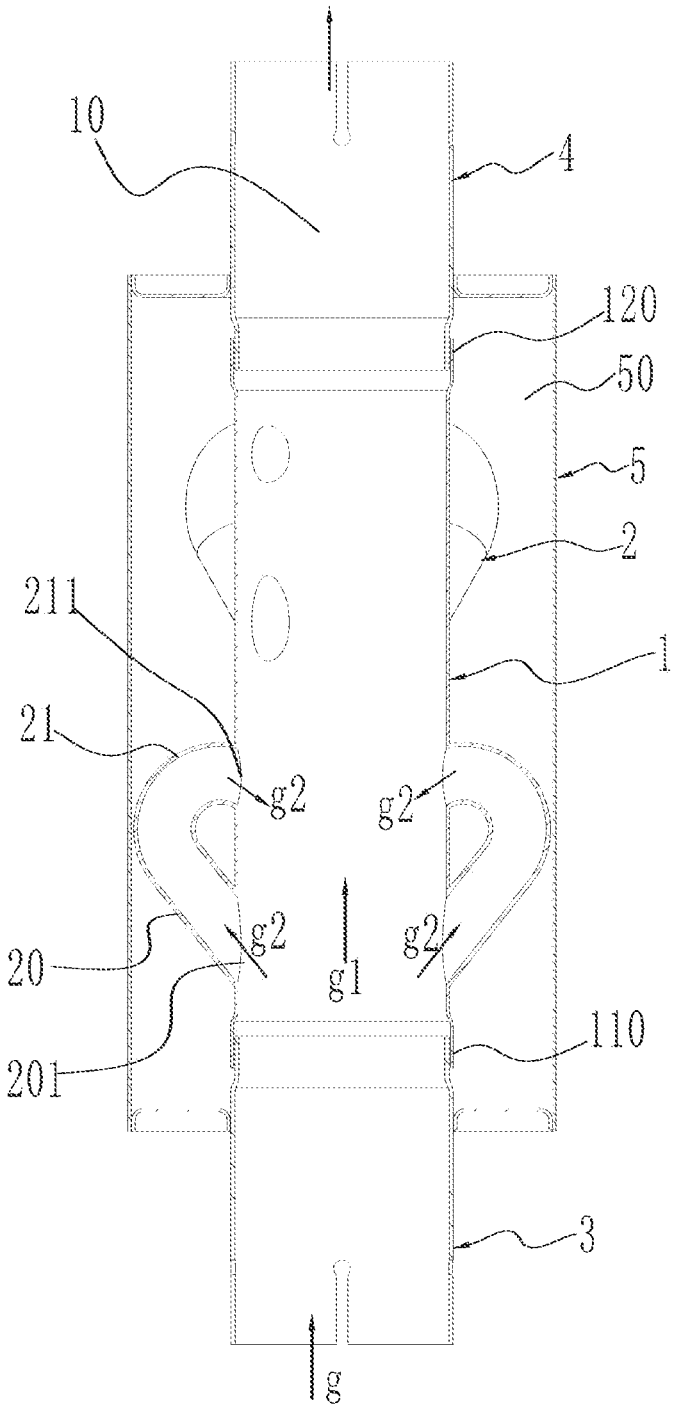
FIG. 2 is a semi-section schematic diagram of FIG. 1.

As shown in FIG. 2, an air flow g may enter the air guide channel 10 from the air inlet end 11 and is divided into a first branch flow g1 and a second branch flow g2 when flowing through the air inlet 201; the first branch flow g1 flows to the air outlet end 12 continuously along the air guide channel 10; the second branch flow g2 enters from the air inlet 201, and is exhausted from the air outlet 211 along the assistant air guide tube and comes together with the first branch flow g1, and the second branch flow g2 may reduce the speed of the first branch flow g1 quickly; and a flow direction of the second branch flow g2 flowing out of the air outlet 211 is opposite to that of the first branch flow g1. It is to be explained that the flow direction of the second branch flow g2 flowing out of the air outlet 211 is opposite to that of the first branch flow g1, which means that the first branch flow g1 flows from bottom to top, i.e., an arrowhead flow direction of g1 in FIG. 2. The second air flow g2 moves towards the air inlet end 11 when the second air flow g2 is exhausted from the air outlet 211 owing to a refluxing effect of the reflux section 20. At the time, the second branch flow g2 comes together with the first branch flow g1 to reduce the speed of the first branch flow g1 quickly. The flow direction of the second branch flow g2 flowing out of the air outlet 211 is opposite to that of the first branch flow g1, which does not mean that the flow direction of the second branch flow g2 is vertically downwards.

Preferably, the guide section 20 inclines outwards gradually from an end close to the air inlet 201 towards an end away from the air inlet 201, the reflux section 21 being arranged in an arc-shaped tube shape. The guide section 20 is arranged as an inclined tube and the reflux section 21 is arranged as an arc-shaped tube. An included angle between the arc-shaped tube in a tangential direction at the end of the air outlet 211 and a center line of the main air guide tube 1 is an acute angle, which guarantees that the flow direction of the second branch flow g2 flowing out of the air outlet 211 from the reflux section 21 is opposite to that of the first branch flow g1. The second branch flow g2 can reduce the speed of the first branch flow g1 effectively, so that the speed of the air flow g entering from the air inlet end 11 and being exhausted from the air outlet end 12 is reduced effectively, and therefore, noise of the air flow is reduced.

It is defined that the air outlet end 12 of the main air guide tube 1 is an upper end and the air inlet end 11 thereof is a lower end. According to an arrangement direction in FIG. 2, the arc-shaped tube inclines downwards in the tangential direction at the end of the air inlet 211, and most of the second branch flow g2 is exhausted along the tangential direction.

Figure 4:
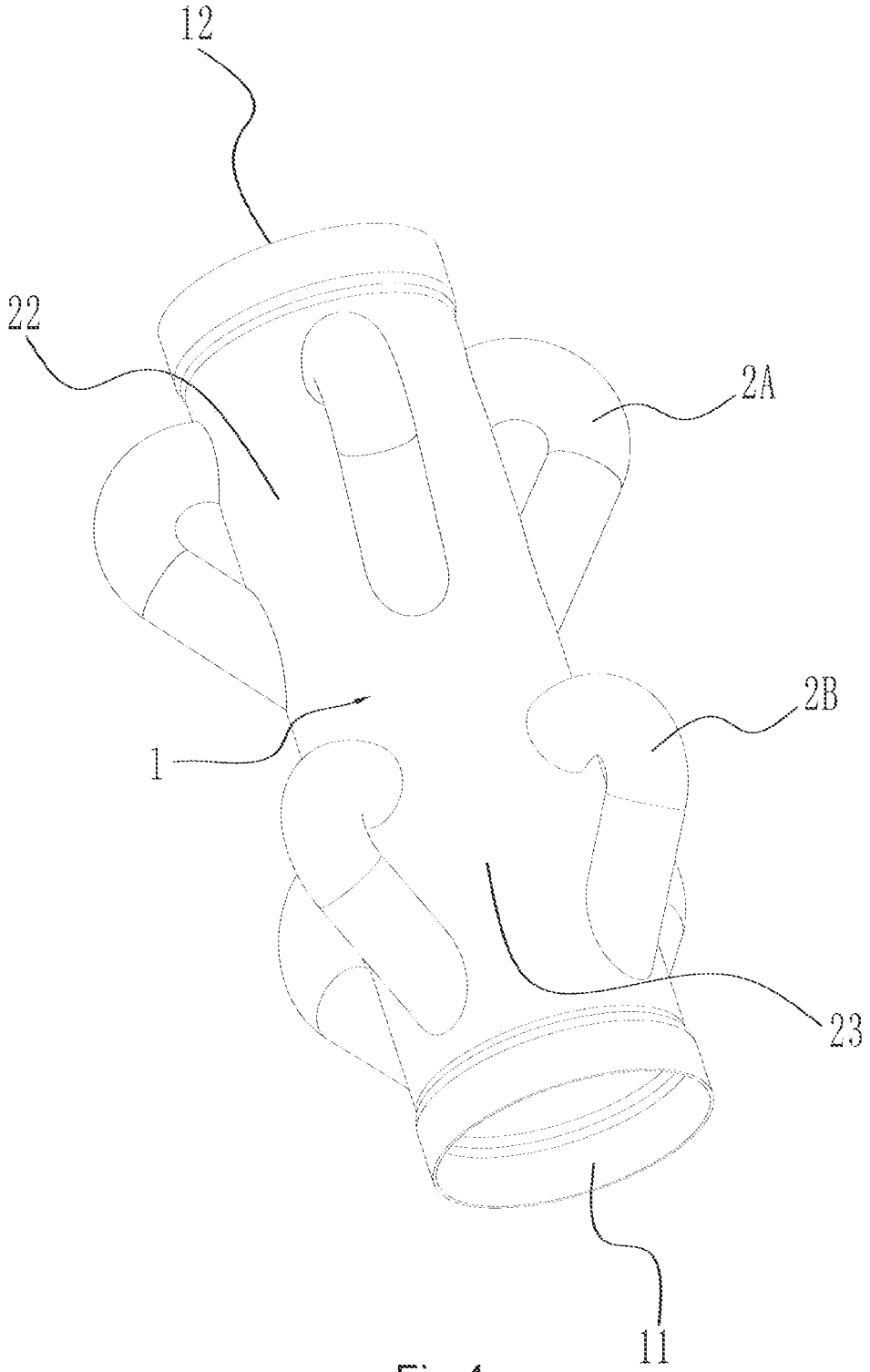
FIG. 4 is an arrangement schematic diagram of main air guide tube and assistant air guide tubes.
Figure 5:
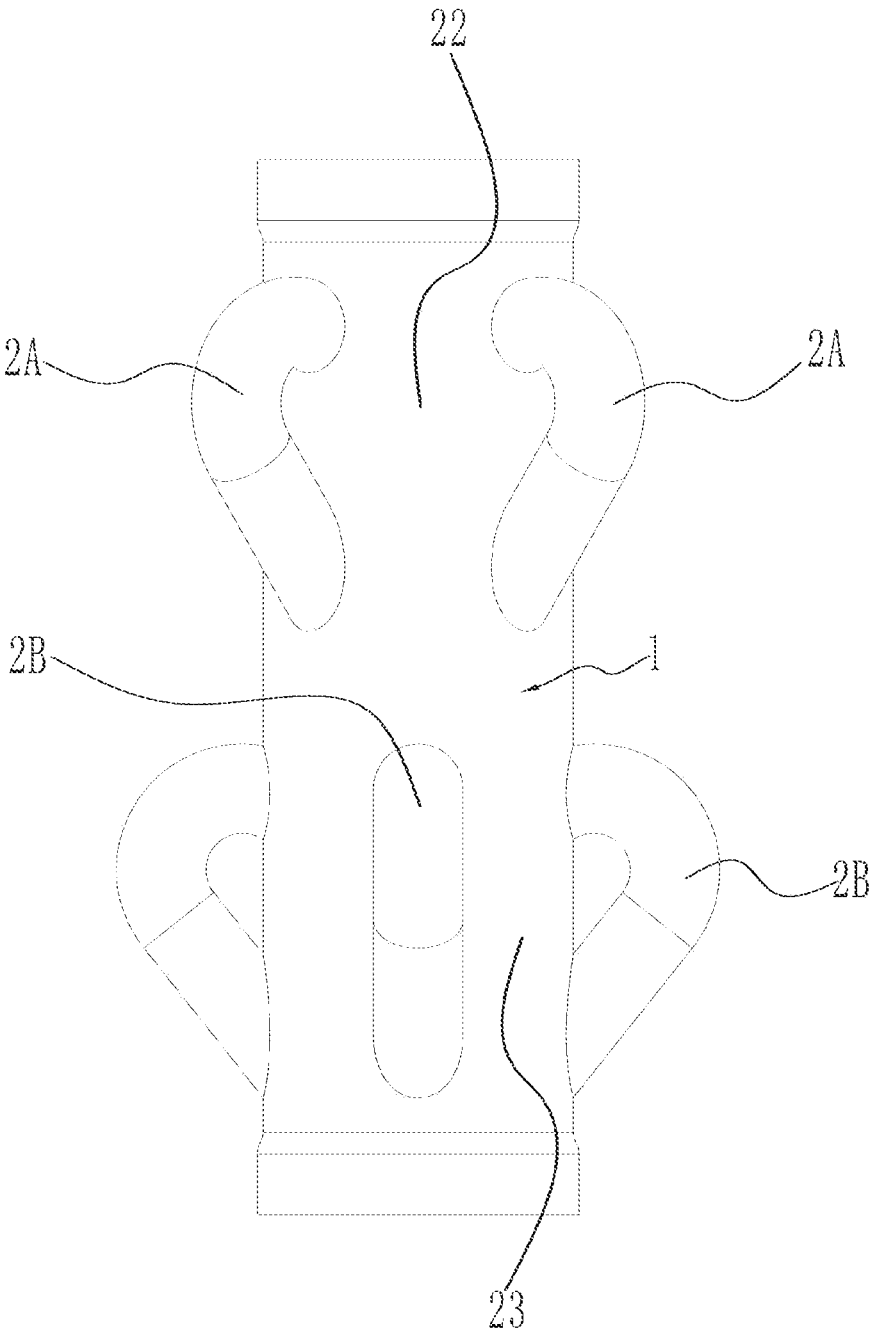
FIG. 5 is a main view of FIG. 4.
Figure 6:
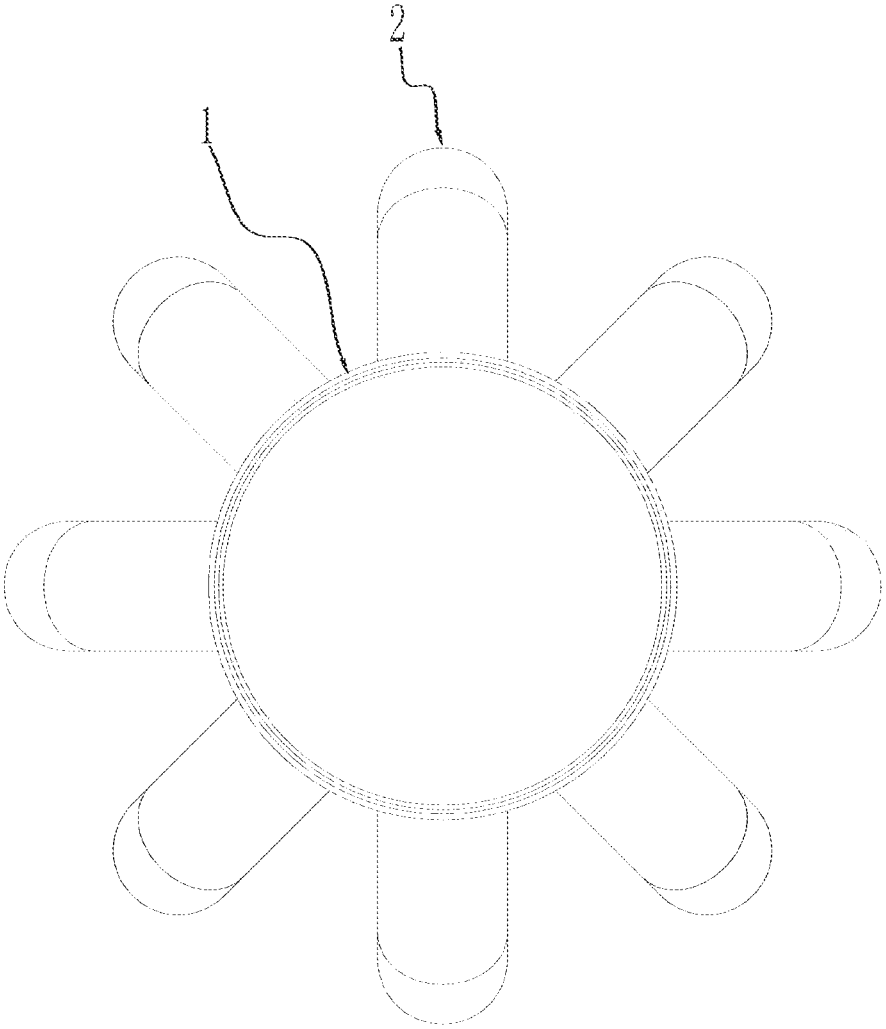
FIG. 6 is a top view of FIG. 4.

As shown in FIG. 4 to FIG. 6, there are a plurality of assistant air guide tubes 2 and the assistant air guide tubes 2 are evenly distributed on an outer wall of the main air guide tube 1. The plurality of assistant air guide tubes 2 may divide the air flow g into a strand of first branch flow g1 and a plurality of strands of second branch flows g2. As the diameter of the main air guide tube 1 is much greater than that of the assistant air guide tubes 2, the speed of the first branch flow g1 may be reduced effectively by means of the plurality of strands of second branch flows g2. The sum of sectional areas of the plurality of assistant air guide tubes 2 is equal to the sectional area of the main air guide tube 1, so that the integral speed reduction effect of the silencer is optimized.

Further preferably, multiple rows of assistant air guide tubes 2 are distributed on the outer wall of the main air guide tube 1, and each row of assistant air guide tubes 2 includes a plurality of assistant air guide tubes 2 evenly distributed in a circumferential direction of the main air guide tube 1. During the use process, the quantity of the assistant air guide tubes 2 may be set according to an actual demand so as to adjust the effect of reducing the speed of the air flow g by the silencer. The air outlet end 12 of the main air guide tube 1 is the upper end, the air inlet end 11 thereof is the lower end; the upper end of the main air guide tube 1 is provided with a plurality of first assistant air guide tubes 2A and the lower end of the main air guide tube 1 is provided with a plurality of second assistant air guide tubes 2B; and a first gap 22 exists between adjacent two first assistant air guide tubes 2A, a second gap 23 exists between adjacent two second assistant air guide tubes 2B, one second assistant air guide tube 2B is arranged below the first gap 22, and one first assistant air guide tube 2A is arranged above the second gap 23. Each row of assistant air guide tubes at the upper and lower ends are distributed fully along the circumferential direction of the main air guide tube 1, so that the speed of the first branch flow g1 is reduced by means of the plurality of strands of decelerated air flows (i.e., the second branch flows g2) in multiple directions, and the speed reduction effect is improved, and thereby, noise is reduced.

During the actual use process, the plurality of assistant air guide tubes 2 are evenly distributed on the main air guide tube 1, and each of the assistant air guide tubes 2 includes the guide section 20 and the reflux section 21 that are communicated with each other. When a gas enters from the air inlet end 11, a part of air flow g (the first branch flow g1) flows towards the air outlet end 12 continuously along the air guide channel 10 while the other part of air flow g (the second branch flow g2) enters from the air inlet 201 of the assistant air guide tube, flows in sequence along the guide section 20 and the reflux section 21, and flows out from the air outlet 211 of the reflux section 21. The flow direction of the air flow g flowing through the reflux section 21 faces the air inlet end 11, i.e., the second air flow g flows through the reflux section 21 to generate a reflux that comes together with the air flow g (the first branch flow g1) flowing towards the air outlet end 11 from the air inlet end 12, so that the speed of the first branch flow g1 may be reduced quickly. During the process where the air flow g moves in the assistant air guide tube, the flow of the air flow g is equivalently lengthened and double speed reduction effects are exerted to the air flow g equivalently, so that the silencing effect is good, and the integral structure of the silencer is quite simple. There is no need to arrange any part in the main air guide tube 1, so that it is also quite easy to manufacture and assemble the silencer.

Figure 3:
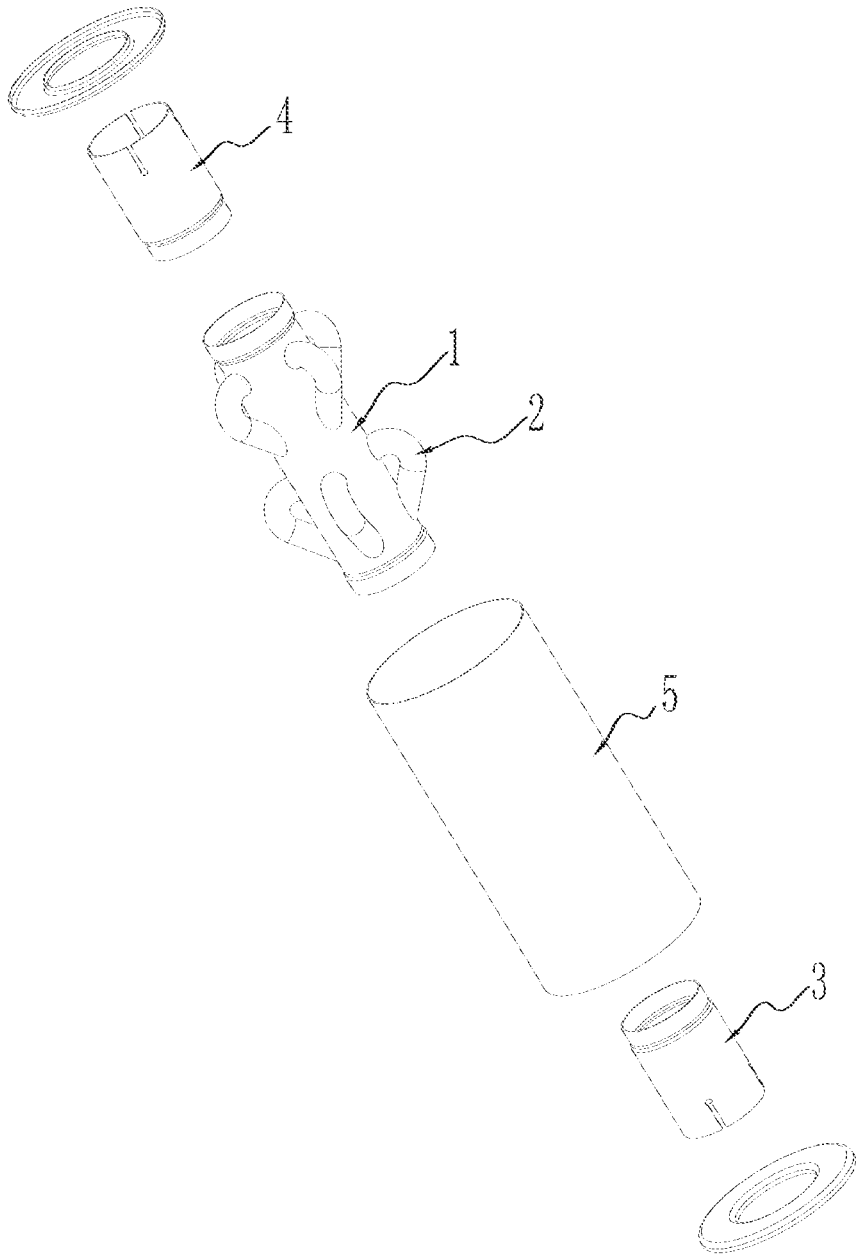
FIG. 3 is an exploded view of the silencer.

As shown in FIG. 1 to FIG. 3, the silencer further includes an air inlet tube 3 and an air outlet tube 4, the air inlet tube 3 being connected with the air inlet end 11 in a plugged manner and the air outlet tube 4 being connected with the air outlet end 12 in a plugged manner. Specifically, the air outlet end 11 is provided with a first convex ring 110 along the circumferential direction of the main air guide tube 1, and the air outlet end 12 is provided with a second convex ring 120 along the circumferential direction of the main air guide tube 1; the air inlet tube 3 is connected in the first convex ring 110 in a plugged manner and the air inlet tube 3 may lean against the first convex ring 110, so that it is guaranteed that the air inlet tube 3 no longer shifts in the main air guide tube 1 continuously; and the air outlet tube 4 is connected in the second convex ring 120 in a plugged manner, and the air outlet tube 4 may lean against the second convex ring 120, so that it is guaranteed that the air outlet tube 4 no longer shifts in the main air guide tube 1 continuously. Both the air inlet tube 3 and the air outlet tube 4 are used for connecting the silencer into a gas circuit, and the air flow enters the silencer from the air inlet tube 3 and is exhausted from the air outlet tube 4, thereby achieving air flow speed reduction and noise reduction effects.

The silencer further includes a housing 5, one end of the housing 5 sleeving the air inlet tube 3 and the other end of the housing 5 sleeving the air outlet tube 4. The housing 5 is arranged in a split manner and the housing 5 includes a round tube and sealing plates arranged both ends of the round tube. The round tube sleeves the two sealing plates, and the housing 5 is fixed to the main air guide tube 1 as the two sealing plates respectively sleeve the air inlet tube 3 and the air outlet tube 4. The housing 5 is provided with an accommodation cavity 50, where both the main air guide tube 1 and the assistant air guide tubes 2 are accommodated in the accommodation cavity 50. The housing not only may shield an internal structure of the silencer to guarantee the aesthetic degree, but also may protect the main air guide tube 1 and all the assistant air guide tubes 2 so as to reduce a condition of air leakage as they are broken by other components.

In the scheme, the silencer is simple and compact in structure, easy to manufacture and assemble, and good in silencing effect, and the whole silencer has few parts.

The specific embodiments described herein are merely illustrations of spirit of the present invention. Various modifications or supplements can be made on the described specific embodiments or can be replaced a similar manner by those skilled in the art without deviating from the spirit of the present invention or surpassing the scope defined by the attached claims.

What is claimed is:

1. A silencer, characterized by comprising:

a main air guide tube provided with an air guide channel, the main air guide tube comprising an air inlet end and an air outlet end away from the air inlet end; and an assistant air guide tube, both ends of the assistant air guide tube being connected with an outer wall of the main air guide tube, and the assistant air guide tube comprising a guide section and a reflux section communicated with each other; an end of the guide section away from the reflux section being provided with an air inlet, and the air inlet being communicated with the air guide channel; an end of the reflux section away from the guide section being provided with an air outlet, and the air outlet being communicated with the air guide channel; and a separation distance between the air outlet and the air inlet end being greater than that between the air inlet and the air inlet end;

wherein an air flow may enter the air guide channel from the air inlet end and is divided into a first branch flow and a second branch flow when flowing through the air inlet; the first branch flow flows to the air outlet end continuously along the air guide channel; the second branch flow enters from the air inlet, and is exhausted from the air outlet along the assistant air guide tube and comes together with the first branch flow; and a flow direction of the second branch flow flowing out of the air outlet is opposite to that of the first branch flow;

multiple rows of assistant air guide tubes are distributed on the outer wall of the main air guide tube, and each row of assistant air guide tubes comprises a plurality of assistant air guide tubes evenly distributed in a circumferential direction of the main air guide tube.

2. The silencer according to claim 1, characterized in that the guide section inclines outwards gradually from an end close to the air inlet towards an end away from the air inlet, the reflux section being arranged in an arc-shaped tube shape.

3. The silencer according to claim 2, characterized in that an included angle between the arc-shaped tube in a tangential direction at an end of the air outlet and a center line of the main air guide tube is an acute angle.

4. The silencer according to claim 2, characterized in that the air outlet end of the main air guide tube is an upper end, the air inlet end thereof is a lower end, and the arc-shaped tube inclines downwards in the tangential direction at the end of the air outlet.

5. The silencer according to claim 1, characterized in that there are a plurality of assistant air guide tubes, and the assistant air guide tubes are evenly distributed on an outer wall of the main air guide tube.

6. The silencer according to claim 1, characterized in that the air outlet end of the main air guide tube is the upper end, and the air inlet end thereof is the lower end; the upper end of the main air guide tube is provided with a plurality of first assistant air guide tubes and the lower end of the main air guide tube is provided with a plurality of second assistant air guide tubes; and a first gap exists between adjacent two first assistant air guide tubes, a second gap exists between adjacent two second assistant air guide tubes, one second assistant air guide tube is arranged below the first gap, and one first assistant air guide tube is arranged above the second gap.

7. The silencer according to claim 1, characterized by further comprising an air inlet tube and an air outlet tube, the air inlet tube being connected with the air inlet end in a plugged manner and the air outlet tube being connected with the air outlet end in a plugged manner.

8. The silencer according to claim 7, characterized in that the air inlet end is provided with a first convex ring along the circumferential direction of the main air guide tube, and the air outlet end is provided with a second convex ring along the circumferential direction of the main air guide tube; and the air inlet tube is connected in the first convex ring in a plugged manner and the air outlet tube is connected in the second convex ring in a plugged manner.

9. The silencer according to claim 7, characterized by further comprising a housing, one end of the housing sleeving the air inlet tube and the other end thereof sleeving the air outlet tube, wherein the housing is provided with an accommodation cavity, in which both the main air guide tube and the assistant air guide tubes are accommodated.

* * * * *